US007152254B2

(12) United States Patent
Smith

(10) Patent No.: US 7,152,254 B2
(45) Date of Patent: Dec. 26, 2006

(54) MOUNTING APPARATUS FOR POOL COVER ASSEMBLY

(76) Inventor: Lanny R. Smith, 815 W. Blue Spruce Rd., Alpine, UT (US) 84004

( * ) Notice: Subject to any disclaimer, the term of this patent is extended or adjusted under 35 U.S.C. 154(b) by 202 days.

(21) Appl. No.: 10/783,591

(22) Filed: Feb. 19, 2004

(65) Prior Publication Data

US 2005/0183196 A1 Aug. 25, 2005

(51) Int. Cl.
*E04H 4/00* (2006.01)

(52) U.S. Cl. ..... 4/502

(58) Field of Classification Search ..... 4/502; 248/298.1, 674–675
See application file for complete search history.

(56) References Cited

U.S. PATENT DOCUMENTS 6,513,175 B1 * 2/2003 Bertoni ..... 4/502

* cited by examiner

*Primary Examiner*—Charles E. Phillips
(74) *Attorney, Agent, or Firm*—Rader, Fishman & Grauer PLLC; Bryan G. Pratt

(57) ABSTRACT

Mounting apparatus is provided for a pool cover assembly having a plurality of pool cover components disposed in a pool cover box and used to operate a pool cover for a swimming pool. The mounting apparatus comprises an elongated member adapted to be attached to the pool cover box, and a mounting member adapted to removably couple at least one of the pool cover components to the elongated member. A method is provided for mounting a pool cover assembly having a plurality of pool cover components in a pool cover box for a swimming pool cover. The method comprises attaching an elongated member to the pool cover box, and removably coupling a mounting member supporting at least one of the pool cover components to the elongated member.

14 Claims, 7 Drawing Sheets

MOUNTING APPARATUS FOR POOL COVER ASSEMBLY

FIELD OF INVENTION

The present disclosure relates to swimming pool covers, and more particularly to mounting apparatus for a pool cover assembly.

BACKGROUND

Swimming pool covers are often used for keeping the water free of trash, to shield the water from sunlight that could degrade protective chemicals in the water and for other purposes. Automatic pool covers are often preferable over manually-operated covers, because the cover can be easily extended when the pool is not in use and retracted during use. In most cases, a pool cover box is located at one end of the pool to hold the cover, motor, winding reel and cable.

FIG. 1 shows a generalized schematic of a swimming pool 10 having a pool deck 12 and coping walls 14 surrounding the pool 10. A pool cover 16 extends from a pool cover assembly 18 in a cover assembly box 20 disposed at one end of the pool 10. A leading edge bar 22 and/or the front edge of the pool cover 16 rides in a track encapsulation 24 along the interior walls of the pool 10. When the pool is not in use, pool cover assembly 18 activates a mechanism (not shown) to pull leading edge bar 22 and cover 16 across the length of swimming pool 10. To make the swimming pool 10 available for use, the cover 16 is retracted by pool cover assembly 18 into the cover assembly box 20 causing leading edge bar 22 to also retract.

Referring to FIG. 2, an abstract view of pool cover assembly 18 is shown. Assembly 18 includes a motor 30, a drive shaft 32 extending from motor 30, a wind-up reel 34 for collecting a rope 36, a gear box 38, and a roll-up tube 40 on which to wind the pool cover 16. Rope 36 extends to a remote pulley system (not shown) and then back to a leading edge of the pool cover 16. Reel 34 and roll-up tube 40 are usually mounted in a free-wheeling fashion on drive shaft 32 to turn independently therefrom. Gear box 38 includes mechanisms to engage either the reel 34 or the roll-up tube 40, depending on whether the pool cover 16 is to be extended or retracted.

The pool cover system shown in FIGS. 1 and 2 is referred to as a right-hand system, since the pool cover motor is located on the right side in the pool cover box. Sometimes the layout of the pool and its surroundings dictate that the pool cover motor be located on the left-hand side of the pool cover box (not shown), referred to as a left-hand system, since the pool cover motor 30 is situated on the left side of the pool cover box. A left-hand system has the same components as the right-hand system shown in FIG. 2, arranged in a mirror-image from that shown in FIG. 2.

Prior art pool cover assemblies were typically permanently mounted with bolts to brackets on the walls and/or to supports on the floor of a pool cover box. To service or replace a component of the pool cover assembly, such as a motor or gear-box, the component had to be unbolted and detached from the brackets and supports, as well as from the other components. To clean leaves and debris from a pool cover box, it was preferable to remove the entire pool cover assembly. However, because of the difficulty in doing so, such cleaning was limited to what could be done without removal of the pool cover assembly.

SUMMARY

A mounting apparatus is provided for a pool cover assembly having a plurality of pool cover components disposed in a pool cover box and used to operate a pool cover for a swimming pool. The mounting apparatus comprises an elongated member adapted to be attached to the pool cover box, and a mounting member adapted to removably couple at least one of the pool cover components to the elongated member.

In another implementation, a method is provided for mounting a pool cover assembly having a plurality of pool cover components in a pool cover box for a swimming pool cover. The method comprises attaching an elongated member to the pool cover box, and removably coupling a mounting member supporting at least one of the pool cover components to the elongated member.

BRIEF DESCRIPTION OF THE DRAWINGS

The above-mentioned features and other features and advantages of this disclosure will become more apparent and the disclosure will be better understood by reference to the following description of an exemplary implementation taken in conjunction with the accompanying drawings, wherein.

Throughout the drawings, identical reference numbers may designate similar, but not necessarily identical, elements. The examples herein illustrate selected implementations of the disclosure in certain forms, and such exemplification is not to be construed as limiting the scope of the disclosure in any manner.

DETAILED DESCRIPTION

In the present description, components of the pool cover assembly are each mounted on a plurality of slides that engage elongated rails on either side of a pool cover box. The slides enable the components of the pool cover assembly to slide in channels longitudinally with respect to the pool cover box. Any of the components of the pool cover assembly can be quickly dismounted from the channels by moving the respective slides to slots strategically cut in the channels and lifting the component out. Conversely, each component can be quickly mounted on the elongated rails by placing the respective slides in slots in the channels and then sliding that component into engagement with an adjacent component. In this manner, a selected component that must be serviced or replaced can quickly be removed from the pool cover assembly and reassembled. In addition, in the same manner described above, the entire pool cover assembly may be easily removed in order to clean or replace the pool cover box.

Figure 1:
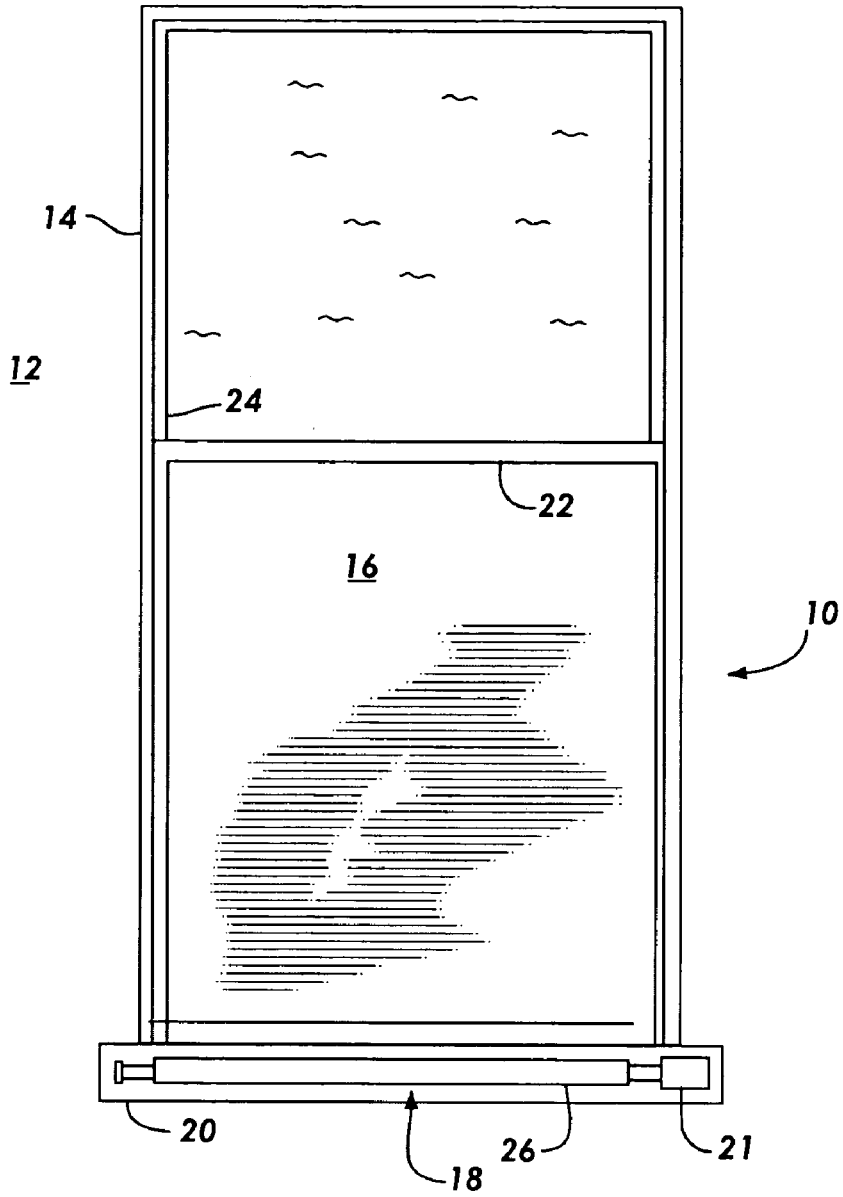
FIG. 1 is a generalized schematic view of a pool showing the location of a pool cover assembly and pool cover box.
Figure 2:
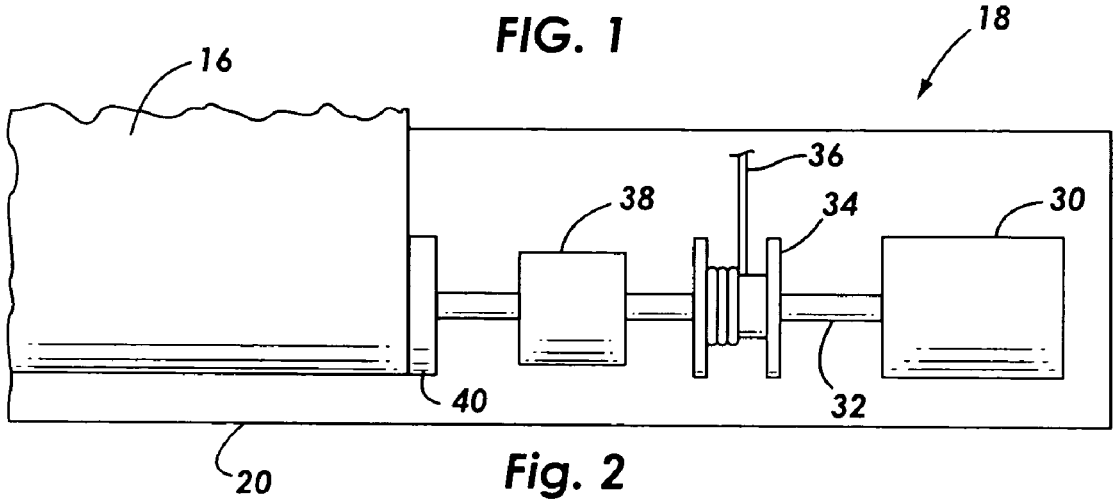
FIG. 2 is a schematic view of the pool cover assembly of FIG. 1.
Figure 3:
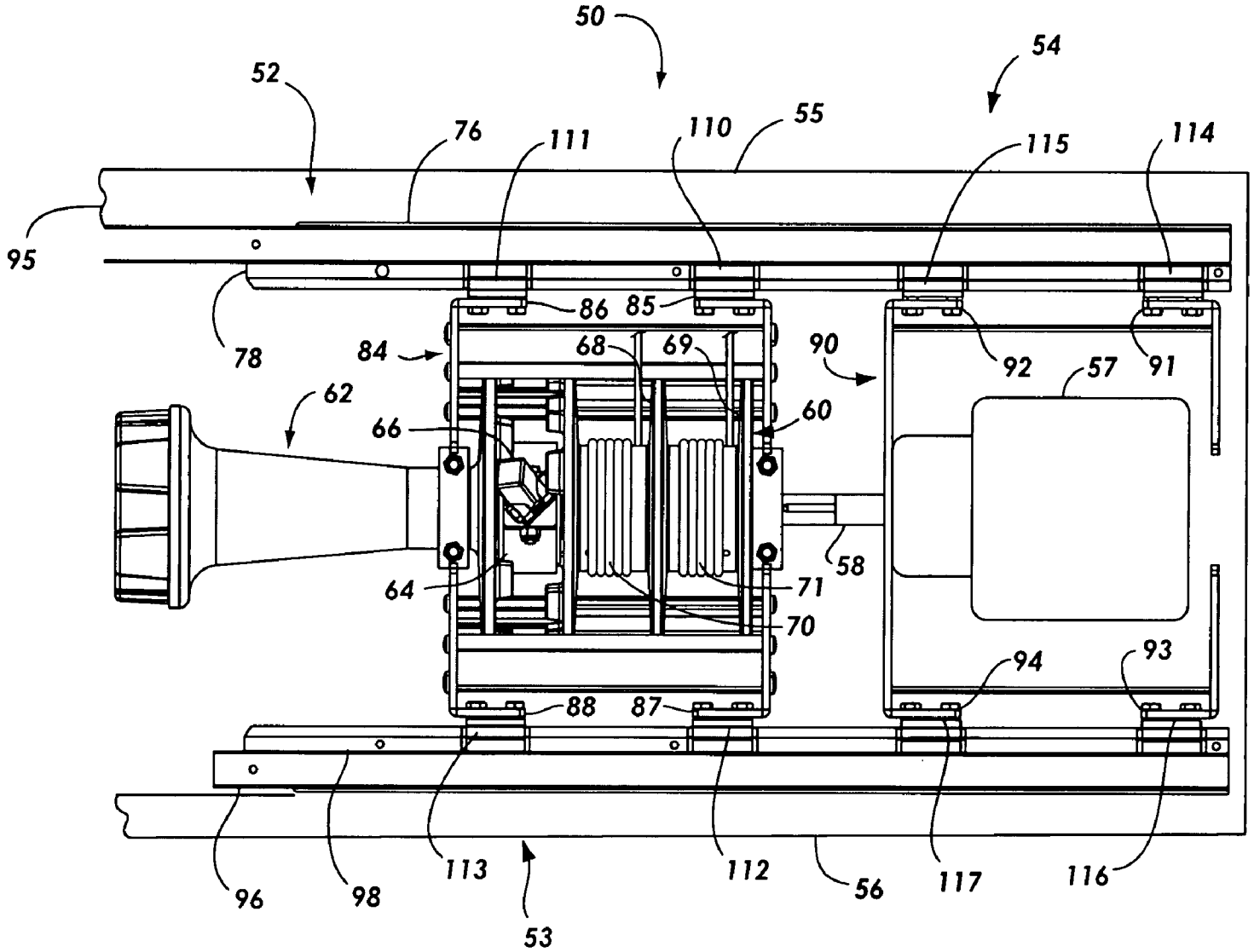
FIG. 3 is a plan view of the rail-mounted apparatus and pool cover assembly, according to one implementation of the present disclosure.
Figure 4:
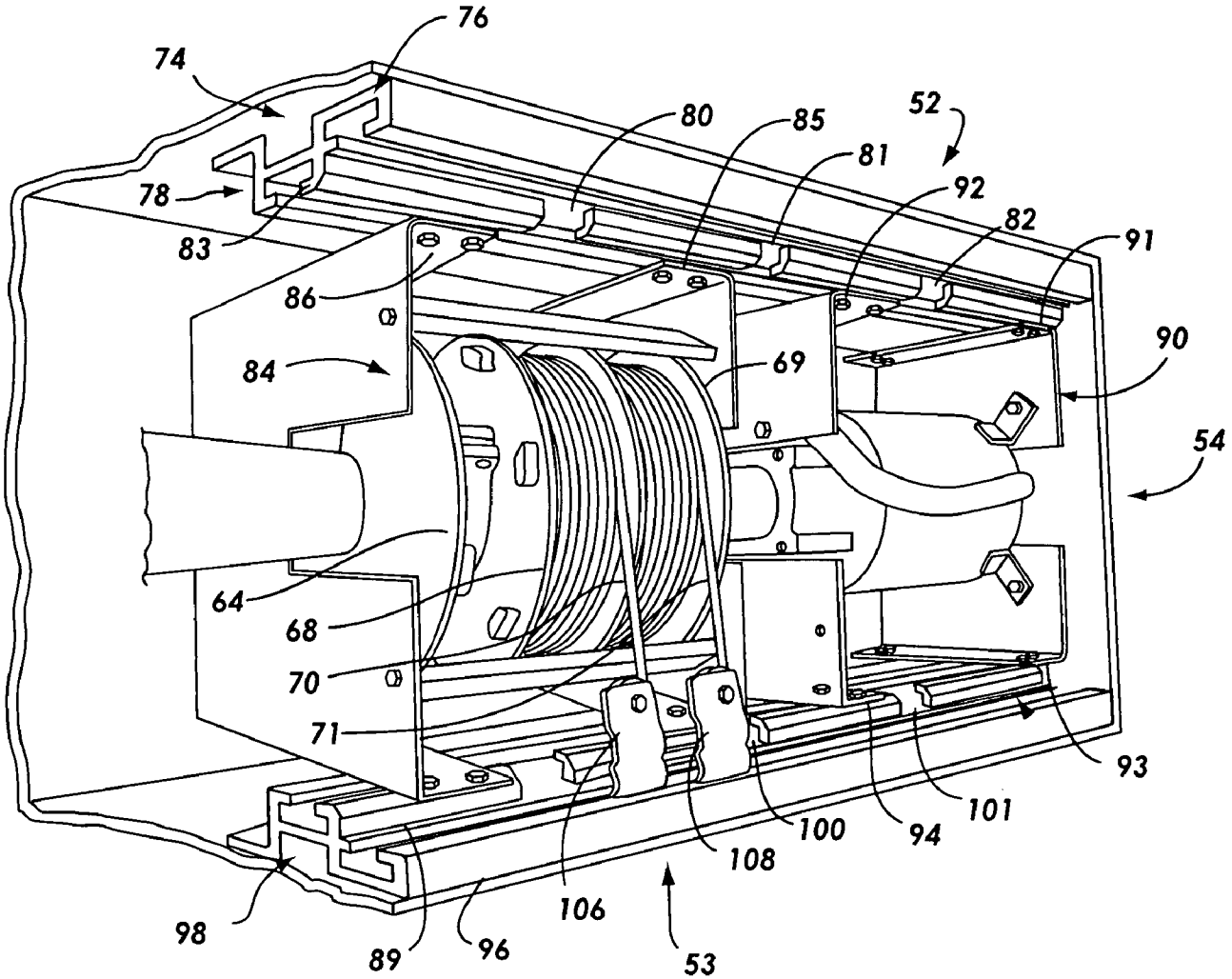
FIG. 4 is a perspective view of the rail-mounted apparatus and pool cover assembly, shown in FIG. 3.

Referring now to FIGS. 3 and 4, an exemplary rail-mounted pool cover assembly 50 is shown. Rail-mounted apparatus 52 and 53 are mounted on opposing sides 55 and 56 of a pool cover box 54. A pool cover motor 57 is disposed in box 54 and is coupled to a reel assembly 60 and a wind-up tube connector 62 by a drive shaft 58. A gear-box unit 64 is disposed between reel assembly 60 and tube connector 62 and rotates with drive shaft 58. Gear box 64 may include a universal shift mechanism 66 that connects drive shaft 58 with either reel assembly 60 or wind-up tube connector 62, depending on whether the pool cover (not shown) is to be retracted or extended. A more detailed description of the universal shift mechanism is given in co-pending patent application entitled "Universal Shift Apparatus and Method For Swimming Pool Cover Assembly," U.S. Ser. No. 10/686,111. Alternately, suitable gear mechanisms other than universal shift mechanism 66 may be employed within the scope of the present disclosure.

Reel assembly 60 may include two co-axial reels 68 and 69, one for retracting and extending each rope 70 and 71, respectively, on either side of the pool cover. Other suitable forms of reel assemblies may be used within the scope of the present disclosure. Wind-up tube connector 62 extends to a wind-up tube (not shown) on which the pool cover is wound or unwound.

As best seen in FIG. 4, rail-mounted apparatus 52 includes an elongated rail-mounting structure 74 that is coupled to the pool cover box 54. Structure 74 includes an elongated support member 76 and an elongated channel member 78. Support member 76 is adapted to be attached by suitable fasteners to a ledge 95 on the pool cover box 54, as seen in FIG. 3. Elongated channel member 78 may also be attached to pool cover box 54 by suitable means. Channel member 78 includes guide members 83 having slots 80, 81 and 82 at selected positions along the length of member 78 between adjacent guide members 83.

Looking at FIGS. 3 and 4, a box-shaped bracket 84 is slidably coupled to channel member 78 by slide members 110 and 111, shown in FIG. 3, coupled to corner pieces 85 and 86 on one side of the bracket 84. The reel assembly 60 is supported within bracket 84. Likewise, a substantially identical box-shaped bracket 90 supports motor 57 therein, as shown in FIG. 3. Bracket 90 is slidably coupled to channel member 78 by slide members 114 and 115 coupled to corners 91 and 92, respectively, on one side of bracket 90 as best shown in FIG. 3.

Another rail-mounted apparatus 53 is coupled to the side 56 of pool cover box 54 opposite to rail-mounted apparatus 52. Rail-mounted apparatus 53 also includes an elongated support member 96 and an elongated channel member 98 having slots 100 and 101 therein. Bracket 84 is slidably coupled to channel member 98 by corner pieces 87 and 88 that are substantially the same as corner pieces 85 and 86 and are coupled to a slide members 112 and 113, respectively. Likewise, opposing corner pieces 93 and 94 of bracket 90 connect bracket 90 to slide members 116 and 117, respectively, in channel member 98. As shown in FIG. 4, two pulleys 106 and 108 are coupled to channel member 98 for directing ropes 70 and 71 to and from reels 68 and 69. Guide members 89 are positioned along channel member 98, with slots 100 and 101 defined between adjacent guide members 89.

Figure 5A:
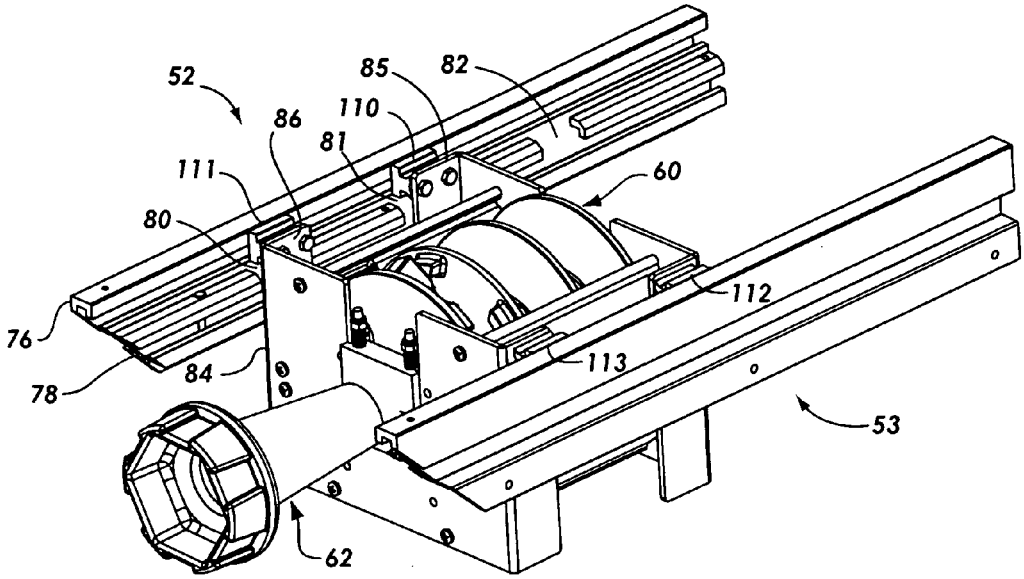
FIG. 5A is a first perspective view of the apparatus and assembly shown in FIG. 3.
Figure 5B:
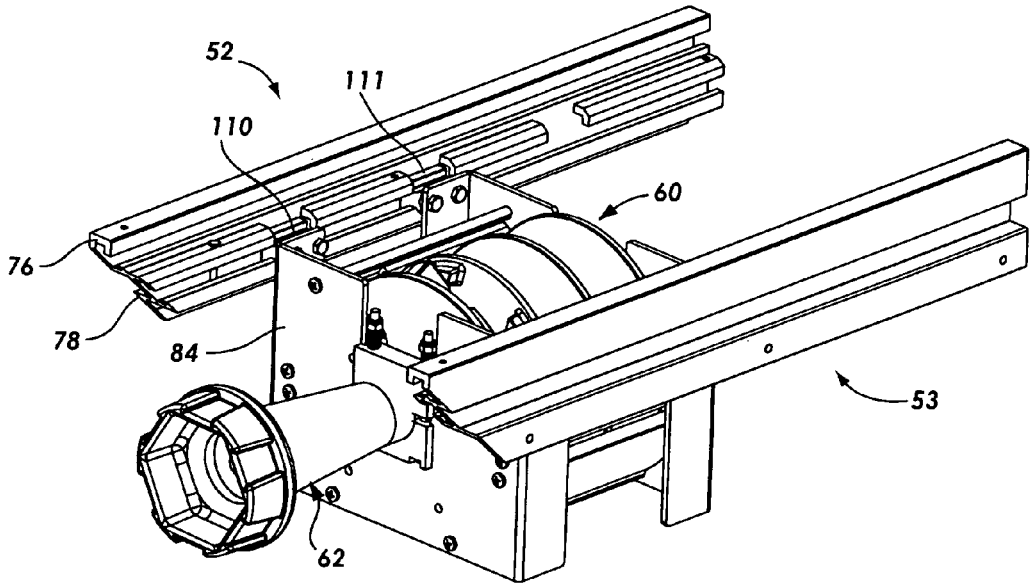
FIG. 5B is a second perspective view of the apparatus and assembly shown in FIG. 3.

FIGS. 5A and 5B are perspective views of the assembly discussed with reference to FIGS. 3 and 4, in which the quick mount and demount features of the present disclosure are shown. Rail-mount apparatus 52 is shown with support member 76 and channel member 78 having slots 80, 81 and 82 defined therein. Slide members 110 and 111 are coupled to corner pieces 85 and 86 of bracket 84. Similar slide members 112 and 113 are coupled to the opposite side of bracket 84, better seen in FIG. 3. To connect bracket 84 and hence reel assembly 60 to the rest of the pool cover assembly 50, slide members 110–113 are positioned over the respective slots in channel members 78 and 98 and dropped into the slots, as better seen in FIG. 5B. The slide members 110–113, and hence bracket 84, are then slide longitudinally along the channel members 78 and 98 to engage with an appropriate component in the pool cover assembly, such as gear box 64, shown in FIG. 6C.

Figure 6A:
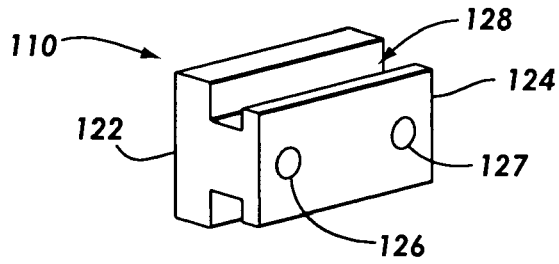
FIG. 6A is a perspective view of a slide member according to the apparatus and assembly shown in FIG. 3.
Figure 6B:
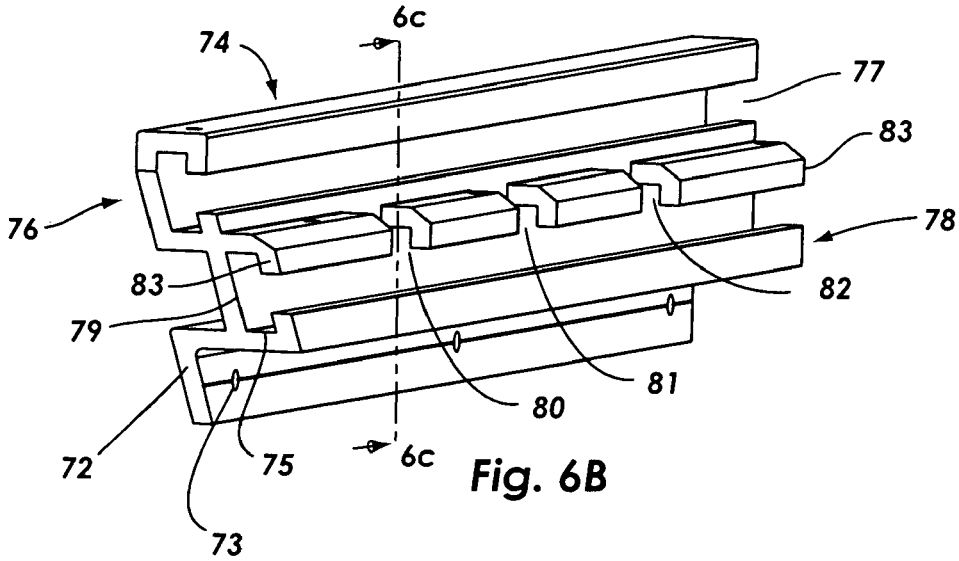
FIG. 6B is a perspective view of a rail member according to the apparatus and assembly shown in FIG. 3.
Figure 6C:
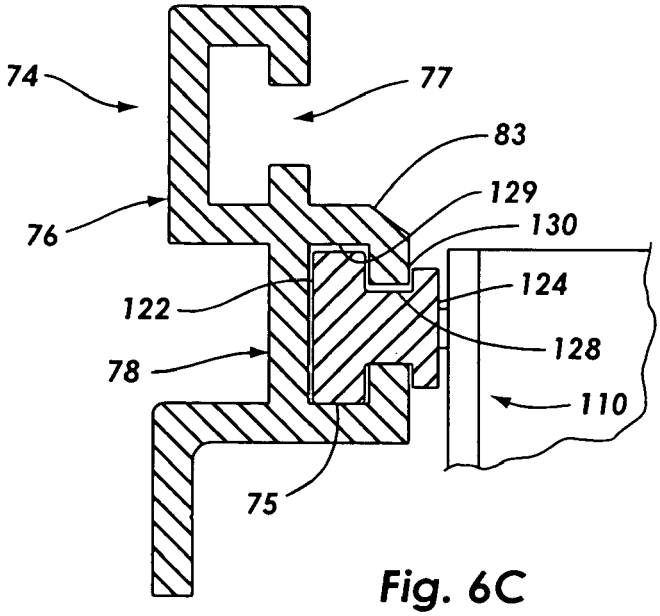
FIG. 6C is a cross-sectional view of the slide member of FIG. 6A engaged with the rail member of FIG. 6B, according to the apparatus and assembly shown in FIG. 3.

FIG. 6A shows one of the slide members 110 in greater detail. Slide member 110 may be an elongated member having a generally H-shaped cross-section with one leg 122 being longer than the other leg 124. The shorter leg 124 may have two openings 126 and 127 for connecting slide member 110 to corner piece 86 of bracket 84, as shown in FIGS. 6B and 6C. The longer leg 122 is dimensioned to slide within an elongated channel (not shown) in channel member 78, as shown in FIGS. 5A and 5B. A trough 128 is disposed between legs 122 and 124 to also engage a portion of channel member 78, as described below. The other slide members 111–113 may be substantially the same shape as shown for slide member 110.

FIG. 6B shows the elongated rail mounting structure 74 in more detail. Support member 76 extends the length of the structure 74 and forms a C-shaped cavity 77. Elongated channel member 78 comprises a flat slide surface 75 and a wall portion 79, and a plurality of guide members 83, each coupled to and spaced along the wall portion 79 to form slots 80, 81 and 82. Guide members 83 are raised above flat slide portion 75 to provide clearance for the longer leg 122 and the trough 128 of slide member 110. Attachment member 72 extends below channel member 78 and has screw holes 73 therein for coupling the rail-mounted apparatus to the pool cover box 54.

FIG. 6C shows a cross-section of the slide member 110 and the elongated channel member 78, illustrating the manner in which members 110 and 78 engage. As shown, leg 122 fits into a corresponding groove 129 in guide member 83 and slides along flat slide portion 75. Similarly, a leg 130 in guide member 83 extends into trough 128 of slide member 110.

Figure 7:
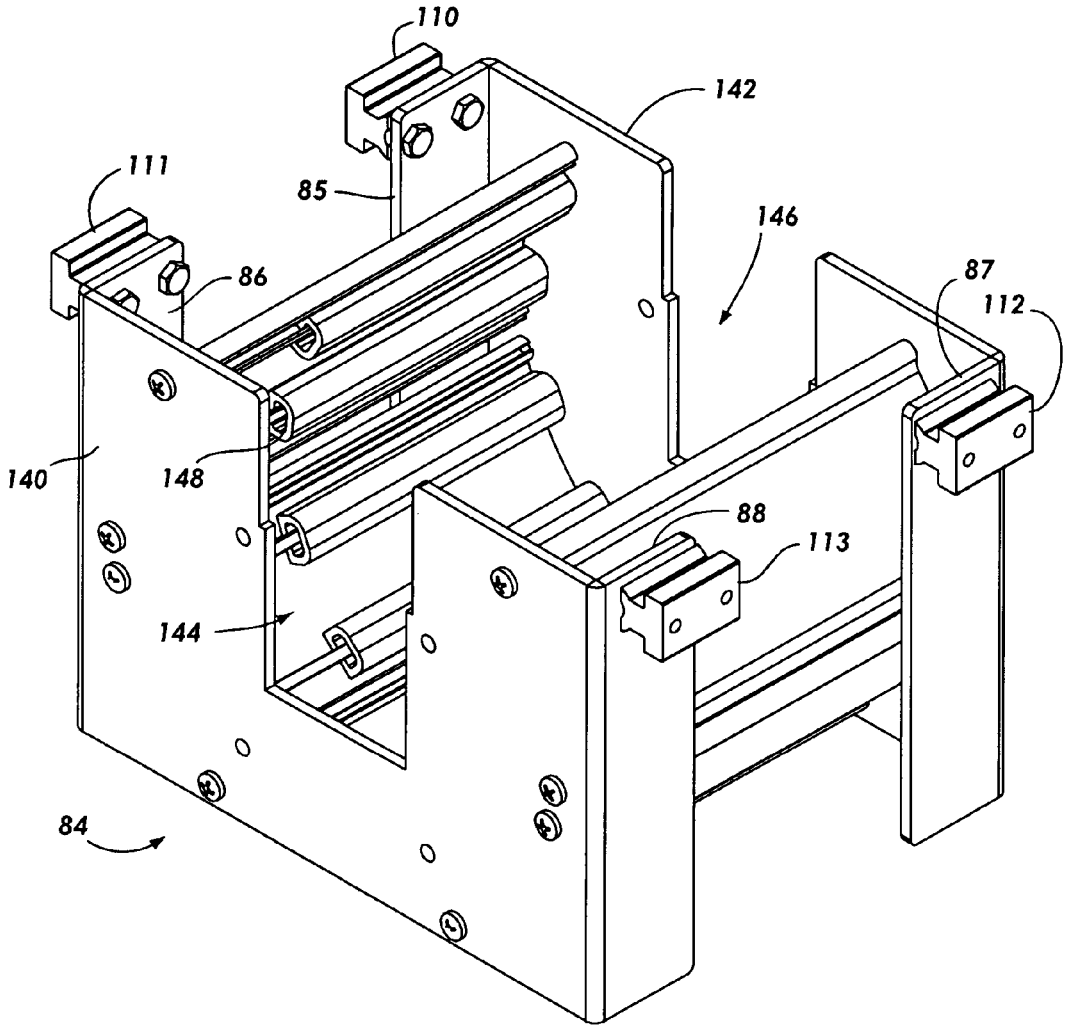
FIG. 7 is a perspective view of the bracket member shown in FIG. 3.

FIG. 7 illustrates bracket 84 in more detail. As previously mentioned, bracket 84 is roughly box-shaped and configured to contain reel assembly 60, as seen in FIGS. 3–5. On one side of bracket 84, corner pieces 85 and 86 are coupled to slide members 110 and 111, respectively. Likewise corner members 87 and 88 are coupled to slide members 112 and 113, respectively. Opposing side members 140 and 142 have deep U-shaped troughs 144 and 146 cut therein to enable engagement with adjacent pool cover assembly components. A plurality of guide members 148 are mounted within bracket 84 to guide the movement of reel assembly 60. Bracket 84 may be sized to stand on the floor of the pool cover box (not shown) or may be supported by conventional support members (not shown) disposed on the floor and/or the walls of the pool cover box. Bracket 90 is essentially identical to bracket 84, except that bracket 90 may be formed without guide members 148. Bracket 90 supports motor 56, which is mounted thereon by suitable means.

Figure 8:
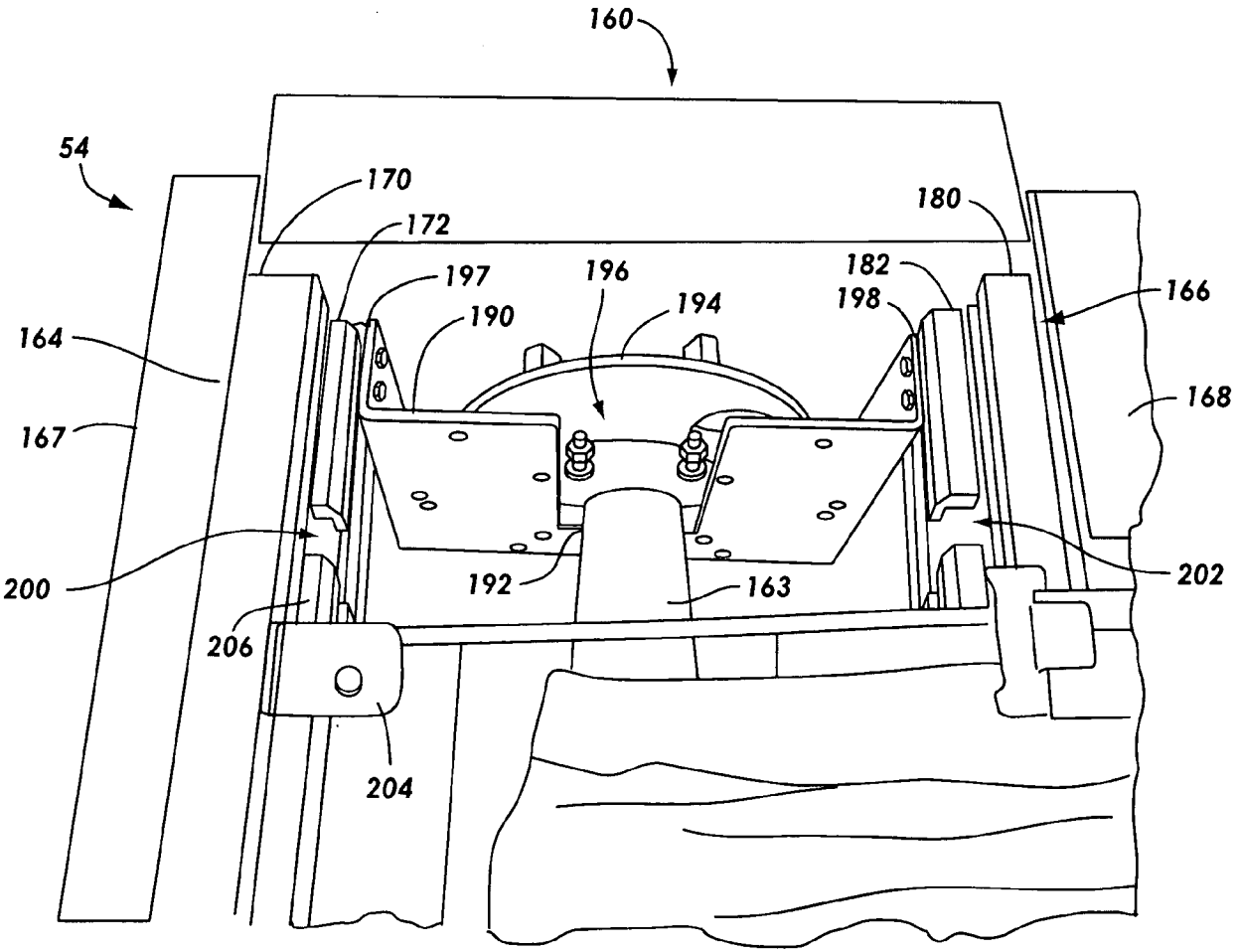
FIG. 8 is a perspective view of the distal end of the wind-up tube of the pool cover assembly of one implementation of the present disclosure.

Looking now at FIG. 8, the distal end 160 of the wind-up tube 163 is shown. Rail-mounting structures 164 and 166 are attached to opposing sides 167 and 168 of pool cover box 54. Rail-mounting structures 164 and 166 have an inverted L-shape, which includes support members 170 and 180 mounted to opposing sides 167 and 168 of the box 54. Channel members 172 and 182 extend at right angles to support members 170 and 180 toward the wind-up tube 163. A bracket member 190 supports the yoke 192 of circular end 194 in a trough 196.

Bracket member 190 has corner members 197 and 198 that are coupled by slide members (not shown) to the elongated channel members 172 and 182, respectively. Slots 200 and 202 are formed in channel members 172 and 182, respectively, to enable the slide members to exit the channel members 172 and 182 so that the distal end 160 of the wind-up tube 163 can be readily removed from the pool cover box 54. A pulley 204 is attached to a support 206 extending from support member 170. Pulley 170 works in cooperation with pulleys 106 and 108 shown in FIG. 4 to direct the ropes that are used to extend and retract the pool cover.

It should be noted that the right-handed pool cover assembly 50 shown in FIGS. 3–8 may be readily switched to a left-handed pool cover assembly, as needed, using the same components described above, but flipped in a mirror image of the assembly shown in the Figures.

The motor is mounted on the left side of the pool cover box and its drive shaft is coupled to the gear-box. As described above, the gear-box is coupled to the wind-up tube or the reel assembly, depending on the orientation of the gear box. The universal shift mechanism 66 described with respect to FIGS. 3 and 4 is rotated 90 degrees, so it will shift opposite to a right-handed system. Finally, the pulleys 106 and 108 shown in FIG. 4 must be flipped over so that the ropes run through the pulleys at the back of the left-hand assembly.

As can be seen from the foregoing disclosure, the pool cover assembly, or any of its components, can easily be attached and detached from the rail-mounting apparatus coupled to the sides of the pool cover box. Thus servicing or replacing any of the pool cover assembly components is a relatively easy task. Likewise, the entire pool cover assembly can be easily removed to clean out the pool cover box. In addition, the modular nature of the mounting brackets, mounting rails and slide members reduce the number of parts that must be manufactured or stored in inventory. The universal shift mechanism enables the pool cover assembly to be used in either a right-hand or left-hand orientation.

While this disclosure has been described as having a preferred design, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A rail-mounted apparatus for a pool cover assembly having a plurality of components disposed in a pool cover box and used to operate a pool cover for a swimming pool, comprising:

(a) an elongated rail member adapted to be attached to a side of the pool cover box;

(b) a bracket adapted to support at least one of the components;

(c) a slide member for removably coupling the bracket to the rail member; and (d) an opening in the rail member in which the slide member may be inserted so that the slide member may removably couple the bracket to the rail member.

2. The rail-mounted apparatus of claim 1, wherein the elongated rail member comprises an elongated support member to couple the apparatus to the side of the pool cover box and a channel member in which the slide member may move longitudinally along the channel member.

3. The rail-mounted apparatus of claim 2, wherein the bracket is disposed to support the component so that component couples with an adjoining component as the slide member moves longitudinally along the channel member.

4. The rail-mounted apparatus of claim 1, wherein the slide member is constructed to couple with the channel member by inserting the slide member into the opening and then sliding it along the channel member.

5. A mounting apparatus for a pool cover assembly having a plurality of pool cover components disposed in a pool cover box, comprising:

(a) an elongated member adapted to be attached to the pool cover box, wherein the elongated member is an elongated rail member adapted to be attached to a first side of the pool cover box;

(b) a mounting member adapted to removably couple at least one of the pool cover components to the elongated member, wherein the mounting member is a bracket adapted to support the pool cover component; and (c) a slide member for removably coupling the bracket to the elongated member.

6. The mounting apparatus of claim 5, wherein an opening is defined in the elongated member in which the slide member may be inserted so that the slide member may removably couple the bracket to the elongated member.

7. The mounting apparatus of claim 6, further comprising a second elongated member adapted to be attached to a second side of the pool cover box opposite the first side.

8. The mounting apparatus of claim 7, further comprising a second slide member adapted to removably couple the bracket to the second elongated member.

9. The mounting apparatus of claim 8, further comprising a second opening in the second elongated member for inserting the second slide member to removably couple the bracket to the second elongated member.

10. A method for mounting a pool cover assembly having a plurality of pool cover components in a pool cover box for a swimming pool cover, comprising:

(a) attaching an elongated member to the pool cover box including attaching an elongated rail member adapted to be attached to a first side of the pool cover box;

(b) removably coupling a mounting member supporting at least one of the pool cover components to the elongated member including removably coupling a bracket adapted to support the pool cover components to the elongated member using a slide member.

11. The method of claim 10, further comprising inserting the slide member into an opening in the elongated member so that the slide member may removably couple the bracket to the elongated member.

12. The method of claim 11, further comprising attaching a second elongated member to a second side of the pool cover box opposite the first side.

13. The method of claim 12, further comprising removably coupling the bracket to the second elongated member using a second slide member.

14. The method of claim 13, further comprising inserting the second slide member into a second opening in the second elongated member to removably couple the bracket to the second elongated member.

* * * * *